US006903295B2

(12) United States Patent
Seto et al.

(10) Patent No.: US 6,903,295 B2
(45) Date of Patent: Jun. 7, 2005

(54) FLUID PRESSURE OPERATING APPARATUS FOR CIRCUIT BREAKER

(75) Inventors: Shinji Seto, Chiyoda (JP); Manabu Takamoto, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/721,324

(22) Filed: Nov. 26, 2003

(65) Prior Publication Data

US 2004/0159808 A1 Aug. 19, 2004

(30) Foreign Application Priority Data

Feb. 14, 2003 (JP) ..... 2003-035930

(51) Int. Cl.[7] ..... H01H 35/38
(52) U.S. Cl. ..... 218/92; 200/82 B
(58) Field of Search ..... 218/84, 86, 88, 218/92, 7, 91–116, 14, 66, 78; 200/82 B, 82 R; 91/417 R, 517, 451, 452, 518

(56) References Cited

U.S. PATENT DOCUMENTS 5,353,594 A * 10/1994 Yamashita et al. ..... 91/417 R
5,604,340 A 2/1997 Yamada et al.
5,750,950 A * 5/1998 Nogami et al. ..... 218/154
6,702,252 B2 * 3/2004 Ben-Asher et al. .... 251/129.19

FOREIGN PATENT DOCUMENTS

JP 2000-090784 3/2000

* cited by examiner

*Primary Examiner*—Lincoln Donovan
*Assistant Examiner*—M. Fishman
(74) *Attorney, Agent, or Firm*—Crowell & Moring LLP

(57) ABSTRACT

A fluid pressure operating apparatus, comprising: a fluid pressure cylinder for opening and/or closing a contact; control valves for use of open operation and/or closed-circuit, for bringing the fluid pressure cylinders into an opened-circuit operation and a closed-circuit operation; and solenoids, each being provided in each of those control valves. Each of those solenoids has a plunger therein. An operation initiating time of the control valves for use of open (operation) differs from that of the control valves for use of close (operation), when operating to open circuit and when operating to close circuit.

10 Claims, 9 Drawing Sheets

FLUID PRESSURE OPERATING APPARATUS FOR CIRCUIT BREAKER

BACKGROUND OF THE INVENTION

The present invention relates to a circuit breaker, and it relates, in particular, to a fluid pressure operating apparatus for such the circuit breaker, being suitable as a circuit breaker for use of electric power.

An example of a conventional fluid pressure operating apparatus for use in a circuit breaker is shown, for example, in Japanese Patent Laying-open No. 2000-90784 (2000) <JP-A 2000-90784>. Such the operating apparatus as described in this publication has a piston for use of opening/closing of a contact, for the operating apparatus to bring the contact into open/close, and a control valve mechanism for actuating this, for preventing the contact from a pumping operation of repeating opening/closing operation thereof. The control valve mechanism has a switching valve and a switching control valve. The directional valve changes over the pressure onto a cylinder operation chamber of a piston for use of opening/closing of the contact. The switching control valve has a switching control valve for use of close (operation) and a switching control valve for use of open (operation). There is provided an anti-pumping piston for closing a check valve, and a conduit is connected to an anti-pumping piston operation chamber, which is branched from a portion between a secondary side of the switching controller valve for use of close (operation) and a primary side of the check valve.

In such the fluid operating apparatus as described in the Japanese Patent Laying-Open No. 2000-90784 (2000) mentioned above, a solenoid drives a pilot valve, and the pilot valve drives the directional control valve, respectively. And, the directional control valve operates a main valve for use of open (operation) and a main valve for use of close (operation). As a result of this, for actuating the piston for driving the contact, the valves are necessary in a large number thereof, thereby bringing about a large-size of the apparatus, as well as, a large number of parts thereof. Also, since the fluid flows directly into a return side of low pressure from a supply side during the operation of the directional control valve, this may be a factor of causing pressure fluctuation, and therefore it is strongly desired to reduce that.

BRIEF SUMMARY OF THE INVENTION

An object, according to the present invention made by taking the problems of the conventional arts mentioned above into the consideration thereof, is to provide the fluid pressure operating apparatus for a circuit breaker, being small in sizes thereof, and also simplified in the structure thereof. Other object, according to the present invention, is to improve reliability of the fluid pressure operating apparatus for a circuit breaker.

For accomplishing the object mentioned above, according to the present invention, first there is provided a fluid pressure operating apparatus, comprising: a fluid pressure cylinder for opening and/or closing a contact; control valves for use of open (operation) and/or close (operation), for bringing said fluid pressure cylinder into an opened-circuit operation and a closed-circuit operation; and driving portions, each being provided in each of those control valves, wherein said driving portions and said control valves are disposed in a same axis thereof.

And, according to the present invention, in the fluid pressure operating apparatus, as described in the above, preferably, said control valve is a poppet valve, and said driving portion is a solenoid of a type of direct movement. And, further preferably, a plunger owned by said solenoid and a valve body owned by said poppet valve have engagement portions, and each of those engagement portions has a length, so that it is longer at said valve body side than that at said plunger side.

Further, according to the present invention, for accomplishing the object mentioned above, there is also provided a fluid pressure operating apparatus, comprising: a fluid pressure cylinder for opening and/or closing a contact; control valves for use of open (operation) and/or close (operation), for bringing said fluid pressure cylinder into an opened-circuit operation and a closed-circuit operation; and solenoids, each being provided in each of those control valves, wherein each of said solenoid has a plunger therein, so that an operation initiating time of said control valves for use of open (operation) differs from that of said control valves for use of close (operation) when operating to open a circuit and when operating to close a circuit.

And, according to the present invention, in the fluid pressure operating apparatus, as described in the above, a penetrating hole may be formed in each of said control valves, within which said plunger is able to move, and a projection portion may be formed at a tip of said plunger, thereby to engage with said control valve at said projection portion, or both said plungers of said solenoid for driving the control valve for use of open (operation) and said solenoid for driving the control valve for use of close (operation) may be disposed on a same axis, and are neighboring with each other on a side opposing to said projection portions of said plungers.

Also, preferably, according to the present invention, in the fluid pressure operating apparatus, as described in the above, a penetrating hole may be formed in each of said control valves, within which said plunger is able to move, and a projection portion may be formed on each of said plungers, thereby engaging said projection portions with said control valves, and further two (2) pieces of said plungers are disposed on a same axis, and a connection rod is provide for connecting between the projection portions of said both plungers. Further, each of said control valves may be a poppet valve. Also, it is preferable that said control valve for use of open (operation) and said projection portion of the plunger engaging with said control valve for use of open (operation) are in contact with under a condition where said control valve for use of open (operation) is closed, while a gap is defined between said control valve for use of close (operation) and said projection portion of the plunger engaging with said control valve for use of close (operation) under condition where the plunger engaging with said control valve for use of open (operation) and said control valve for use of close (operation) are in contact with, on the other hand said control valve for use of close (operation) and said projection portion of the plunger engaging with said control valve for use of close (operation) are in contact with under a condition where said control valve for use of close (operation) is closed, while a gap is defined between said control valve for use of open (operation) and said projection portion of the plunger engaging with said control valve for use of open (operation) under condition where the plunger engaging with said control valve for use of close (operation) and said control valve for use of close (operation) are in contact with.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE INVENTION

Figure 1:
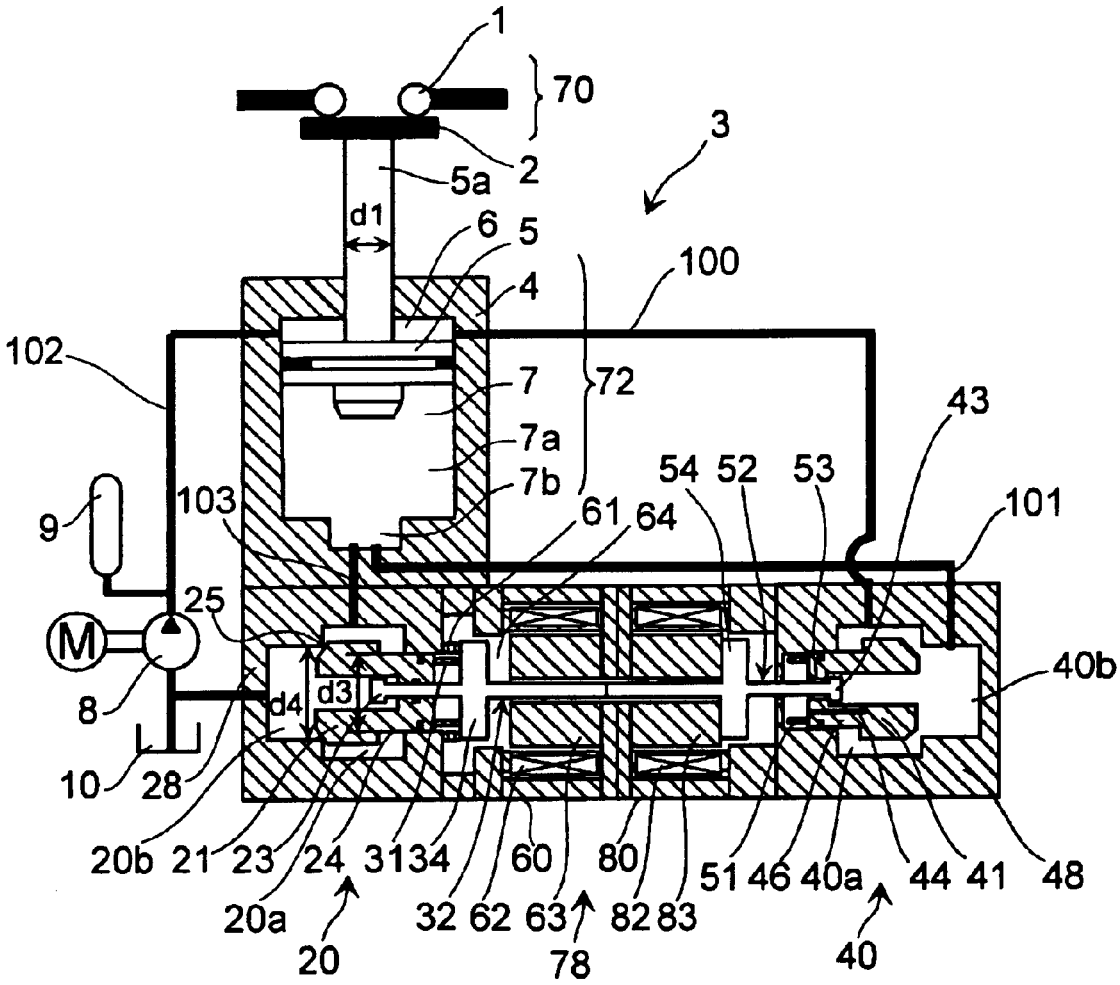
FIG. 1 is a vertical cross-section view of an embodiment of the circuit breaker, according to the present invention.
Figure 2:
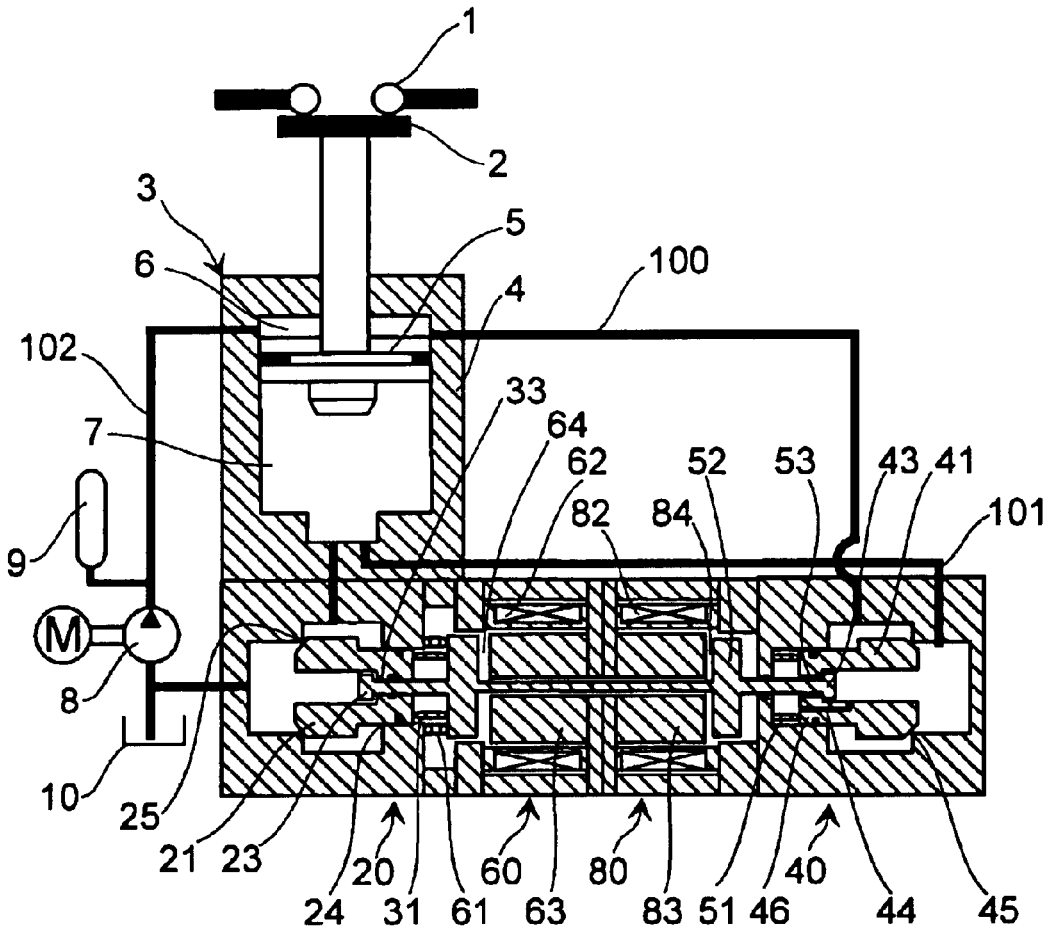
FIGS. 2 to 4 are the vertical cross-section view for explaining the operation thereof.
Figure 4:
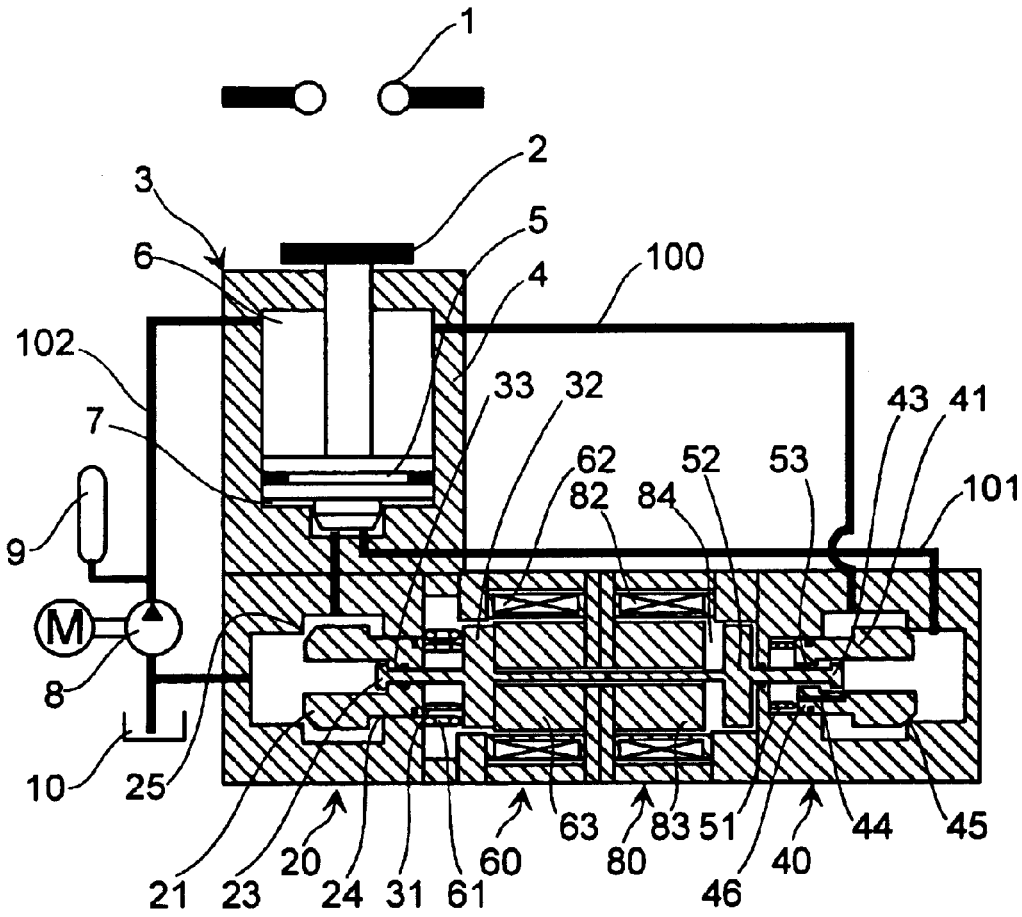
Figure 5:
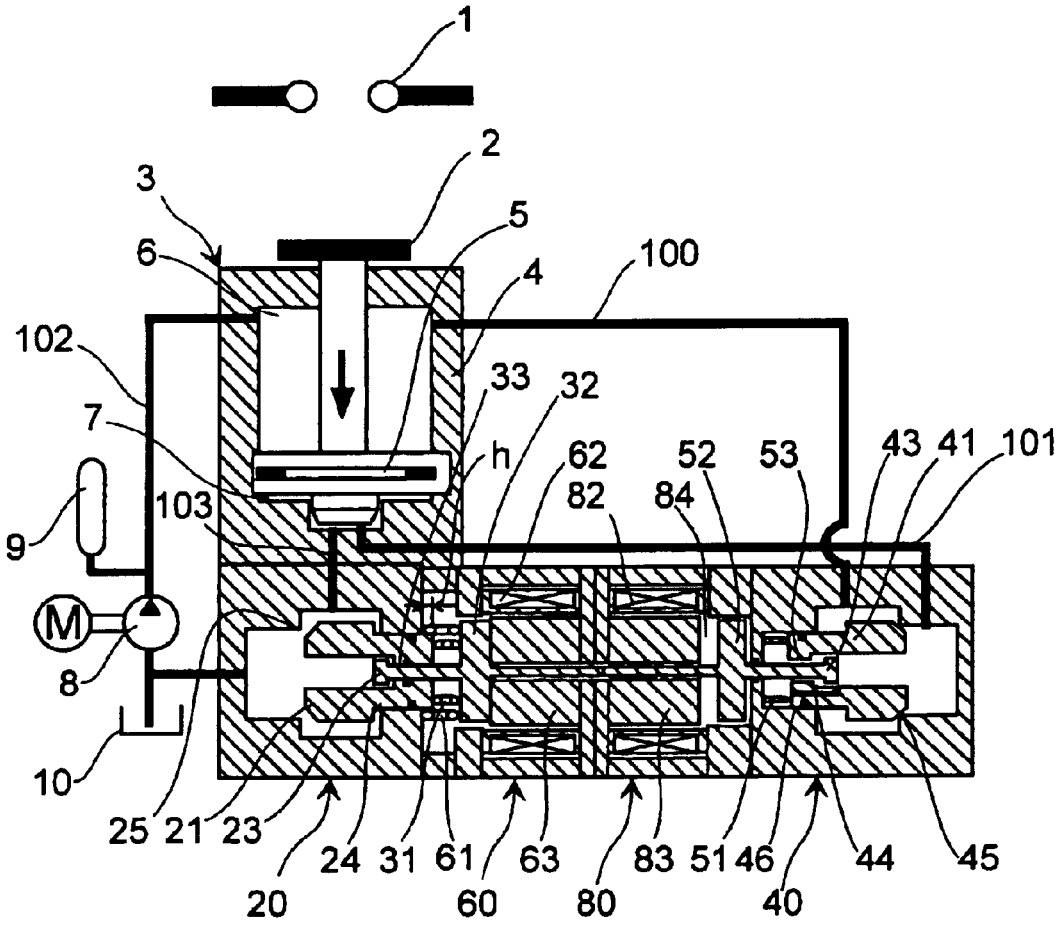
FIG. 5 is a vertical cross-section view for showing a variation of the circuit breaker shown in FIG. 1.

Hereinafter, embodiments according to the present invention will be fully explained by referring to the attached drawings, in particular the vertical cross-section views shown in FIGS. 1 to 8. Herein, FIG. 1 is a view where the circuit breaker is in a condition of the closed-circuit thereof; i.e., during the conduction period thereof. FIG. 2 shows an initial condition in an operation of open-circuit, and FIG. 3 a condition in an internal period of the open-circuit, respectively. FIG. 4 is a view for showing the closed-circuit condition thereof; i.e., the cut-off condition. FIG. 5 shows the latter period of the open-circuit condition, FIG. 6 an initial condition of the operation of closed-circuit thereof, FIG. 7 a middle period of the operation of closed-circuit thereof, and FIG. 8 a latter period of the operation of closed-circuit thereof, respectively.

The fluid pressure operating apparatus 3 for a circuit breaker comprises a fluid pressure cylinder portion 72 for opening and/or closing a contact portion 70, a control valve 20 for use of open (operation) and a control valve 40 for use of close (operation), for changing over the pressurized fluid, which is supplied onto the fluid pressure cylinder portion 72, and a driving portion 78, having a pair of solenoids 60 and 80, for driving those control valves 20 and 40, respectively. The contact portion 70 has a movable contact 2 and a contact 1, on which the movable contact 2 is on contact with.

The pressure cylinder portion 72 has a cylinder 4, in which a cylinder space 7 is formed, for the movable contact 2 to move therein, and a piston 5, which moves in an inside of this space 7. The piston is attached onto a connecting rod 5*a*. Neighboring to the pressure cylinder portion 72 is provided the control valve 20. The control valve 20 and the driving portion 78 are disposed or aligned in a straight line-like manner.

On the driving portion 78 disposed at a center of the straight line, a solenoid 60 for use of open (operation) and a solenoid for use of close (operation) are disposed, fitting back to back thereof. At a central portion of each of those solenoid 60 and 80, there is disposed a fixed core 63 or 83, respectively, and through penetrating holes formed in the fixed core 63 and 83 can move a plunger 32 for use of open (operation) and a plunger 52 for use of close (operation), each of which has a disc portion 34 or 54, respectively. On a side of an outer diameter of the fixed cores 63 and 83 are disposed coils 62 and 82 opposing to those fixed cores 63 and 83, respectively. The plunger 32 for use of open (operation) and the plunger 52 for use of close (operation) fit to each other at a small diameter portion on a rear surface side thereof.

When current flows into the coil 62 of the solenoid 60 for use of close (operation), electromagnetic suction force is generated between the fixed core 63 and the plunger 32 for use of open (operation), and the plunger 32 for use of open (operation) narrows a gap 64. On the contrary to this, when current of the solenoid 80 for use of close (operation) flows into the coil 82, electro-magnetic suction force is generated between the fixed core 83 and the plunger 52 for use of close (operation), and then the plunger 52 for use of close (operation) narrows a gap 84.

The control valve 20 for use of open (operation) and the control valve 40 for use of close (operation) are symmetric to each other. Thus, they have a container or vessel structure, each being opened to a side of the driving portion 78, and they hold valve bodies 21 and 41 within housing 28 and 48, each being formed with a penetrating hole at a center portion thereof. The valve bodies 21 and 41 have a stage-like structure, each having a cylindrical a portion 24 or 46, having a small diameter at a side of the driving portion 78, while at a neighboring side thereof have a cylindrical portion having a large diameter. End portions of those small diameter cylindrical portions 24 and 46 are attached to the housings 28 and 48, hermetically. Corner portions of the large diameter cylindrical portions are formed to be taper-like, and are abutted onto valve seats, being corner portions of the stages of those housings. The penetrating holes formed in the valve bodies 21 and 41 are staged holes, on each of those staged portions abutting a projection portion 23 or 43, which is formed at the tip of the plunger 32 or 52.

On an end surface of the valve body 21 of the control valve 20 for use of open (operation) at the side of the driving portion 78, the disc portion of the plunger 32 is in contact with at one end side thereof, on the other end side of which is disposed a second spring 31 in contact with the valve body 21. On the other hand, so as to be in contact with the end surface of the control valve 40 at the side of the driving portion 78 and the housing 48 at both end portions thereof, a third spring is disposed. Further, on one side of an outer diameter of the second spring 31, so as to be in contact with the housing 28 for use of open (operation) and the plunger 32 for use of open (operation) at both end portions thereof, a first spring 61 is disposed.

A space 7 within the cylinder 4 has a staged shape, and at the staged portion 7*b* can be fit a tip portion 5*b* of the piston 5. Between a space 6 on a side of the moveable contact 2 within the space 7, which is divided into two (2) by the piston 5, and an inside of the housing 28 of the control valve 20 for use of open (operation), there is a conduit 102 communicating with each other. Also, a communication hole 103 is formed between the staged portion 7*b* of the space 7 and the staged portion 20*a* of the control valve 20 for use of open (operation), and a communication hole is between the staged portion 7*b* of the space 7 and the staged portion 40*b* of the control valve 40 for use of close (operation). Further, between the space 6 of the cylinder 4 and the staged portion 40*a* of the control valve for use of close (operation), there is a conduit 100 communicating with each other.

On way of the conduit 102 is provided an oil pressure pump 8, which is driven by an electric motor, and an accumulator 9 is attached thereto, branching from this conduit. In the accumulator 9 is stored an operating oil of high pressure, which is pressurized by the oil pressure pump 8. The conduit dividing in an upper stream of the oil pressure pump 8 is communicated to a reservoir 10 of low pressure. Into this reservoir 10 is collected a fluid discharged from the fluid pressure operating apparatus 3, thereby to be stored therein.

Into the space 6 of the space 7 within the cylinder 4, a supply pressure of high pressure of the operating fluid always acts, which is pressurized by the oil pressure pump 8 and accumulated in the accumulator 9. On the other hand, into the other space 7*a* of the space 7 within the cylinder 4 is given a return pressure of low pressure from the supply pressure of high pressure or the reservoir 10, selectively, by the valve function of the control valve 20 for use of open (operation) and the control valve 40 for use of close (operation). An area for receiving pressure of the space 6 is smaller than that of the space 7*a*, by a cross-section area of the connecting rod 5*a*, e.g., ($\pi d_1^2/4$).

The control valve 20 for use of open (operation) is of a two-way valve. It communicates the space 7*a* of the cylinder 7*a* to the return side of low pressure, to push the piston downwards in FIG. 1, thereby opening the contact portion 70. A diameter d3 of the cylindrical portion 24 in the valve body 21 of the control valve 20 for use of open (operation) is smaller than the diameter d4 of the valve seat 25. A rear surface of the cylindrical portion 24 is opened to the atmospheric pressure. Under the condition of closed-circuit, the supply pressure for the difference of the area between the valve seat 25 and the cylindrical portion 24; e.g., $\{\pi(d_4^2-d_3^2/4)$, thereby holding the control valve 20 for use of open (operation) in the condition of being closed.

The control valve 40 for use of close (operation) is of a two-way valve of a poppet valve type. It communicates the space 7*a* of the cylinder to the supply side of high pressure, to push the piston upwards in FIG. 1, thereby closing the contact portion 70. The diameter d5 of the cylindrical portion 46 in the valve body 41 is smaller than the diameter d6 of the valve seat 45.

Operations in the embodiment being constructed in this manner will be explained, hereinafter.

FIG. 1 shows the condition of the closed-circuit. All of the space 6 of the cylinder, a secondary side space 40*b* of the control valve 40 for use of close (operation), communicating to the space 6 through the conduit 101, a primary side space 40*a* communicating to the secondary side space 40*b*, and a secondary side space 20*a* of the control valve 20 for use of open (operation) are high in the pressure. A primary side space 20*b* of the control valve 20 for use of open (operation) is low in the pressure.

Namely, the control valve 20 for use of the open (operation) is closed, and the secondary side space 20*b* is held at low pressure while at high pressure the staged portion 20*a*, being the primary side space. In the control valve 40 for use of close (operation), the secondary side space 40*b* and the primary side space 40*a* are communicated with. The plunger 52 for use of close (operation) keeps moving into the left-hand side in FIG. 1, up to the position where the side surface of the disc portion 54 is in contact with the fixed core 83 of the solenoid 80. Since the plunger 52 for use of close (operation) is moving into the left-hand side, the plunger 32 for use of open (operation) is also moving into the left-hand side. Also, through both of the spaces 6 and 7*a* within the cylinder 4 are kept at high pressure, since the pressure receiving area of the space 6 is smaller than that by the cross-section area of the connecting rod; e.g., ($\pi d_1^2/4$), the piston 5 is pushed upwards.

The situation is shown in FIG. 2 where an instruction of open-circuit is generated after the condition shown in this FIG. 1. Upon the instruction of open-circuit, the coil 62 of the solenoid 60 for use of open (operation) is excited. Excitation of the coil 62 generates a force for suctioning the disc portion 34 of the plunger 32 for use of open (operation), and the gap 64 is shortened between the fixed core 63. Accompanying with movement of this plunger 32 for use of open (operation), also the plunger 52 for use of close (operation) moves to the right-hand side. In this instance, since high voltage is applied to the plunger 52 for use of close (operation), it comes to be a resistance. Also, a friction force is generated, however the suction force of the plunger 32 is set to be a value overcoming those resistances thereof.

When the plunger 52 for use of close (operation) moves to the right-hand side, the valve body 41 of the control valve 40 for use of close (operation) moves to the right-hand side. As a result of this, the control valve 40 for use of close (operation) is closed. In this instance, between the side surface on the projection portion 23 of the plunger 32 for use of open (operation) and the staged portion on the valve body 21 of the control valve 20 for use of open (operation), a gap is defined. When the gap is defined in this manner, it is possible to prevent the plunger 32 from moving the valve body 21 for use of open (operation), even if the plunger 32 moves into the right-hand direction. Accordingly, it is possible to keep the control valve for use of open (operation) in the condition of being closed. Since both the control valve 20 for use of open (operation) and the control valve 40 for use of close (operation) are closed, it is possible to avoid blow-by from the side of the accumulator 9 of high pressure to the side of reservoir 10 of low pressure.

Figure 3:
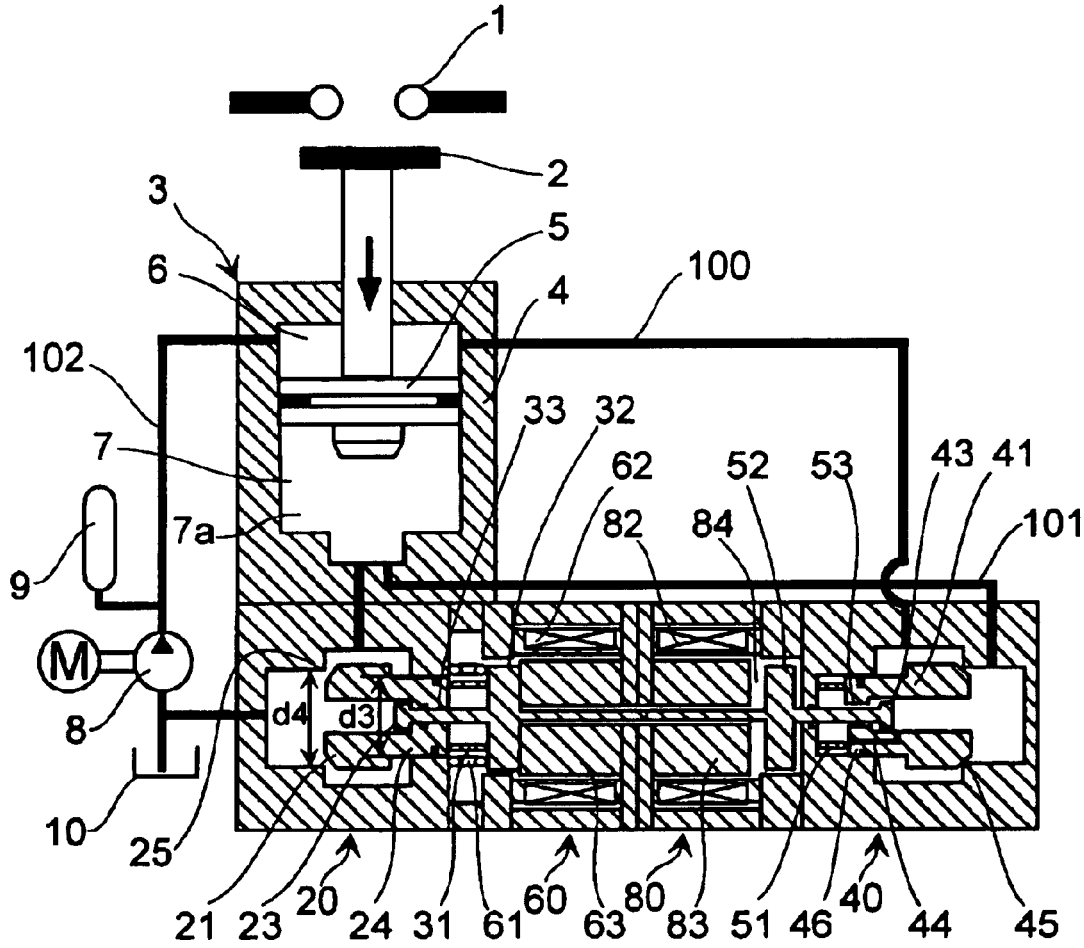

The situation is shown in FIG. 3, where the operation of open-circuit proceeds from the condition shown in FIG. 2. The plunger 32 for use of open (operation) moves into the right-hand direction, and the projection portion 23 is in contact with the valve body 21 of the control valve 20 for use of open (operation). Under this condition, the plunger 32 moves the valve body 21, further, into the right-hand direction, if the suction force of the solenoid 60 overcomes the sum of a force due to the pressure of operating fluid, which acts upon the difference of cross-section area; e.g., $\Delta S=\{\pi(d_4^2-d_3^2)/4\}$, between the valve seat 25 and the cylindrical portion 24 of the control valve 20 for use of open (operation). With this, the control valve 20 for use of open (operation) opens.

As is apparent from the equation of the difference of cross-section area $\Delta S$, if the difference is small in the diameter between the valve set at 25 and the cylindrical portion 24, the suction force comes to be small necessary for driving the plunger 32 for use of open (operation). The plunger 32 moves to the right-hand direction until when it abuts on the fixed core 63 of the solenoid 60 for use of open (operation) at the side surface thereof. Accompanying with this, the plunger 52 for use of close (operation) also moves to the right-hand direction, however the valve body 41 will not move since it comes out from the engagement with the plunger 52, and then the control valve 40 for use of close (operation) keeps the condition of being closed.

When the control valve 20 for use of open (operation) is opened, the space 7*a* of the cylinder 4 is communicated to the reservoir 10 of low pressure through the staged portion 20*a* of the control valve 20 for use of open (operation). Since the space 7*a* goes down to low pressure, the force applying upon the piston from the side of the space 6, upon which the high pressure is always applied, comes to be larger than the force, which is applied upon the piston from the side of the space 7*a*, thereby pushing down the piston 5. As a result of this, the connection between the movable contact 2 and the contact is broken down, thereby starting the operation of open-circuit.

The situation is shown in FIG. 4, where the piston 5 reaches to the bottom dead center thereof during the proceeding of the operation of open-circuit. The plunger 32 stays at the position where it moves due to the spring force of the first spring 61 even when a current instruction is cut off to the solenoid 60. With this, the control valve 20 for use of open (operation) keeps the condition of opening, while the piston stays at the bottom dead center.

In the embodiment mentioned above, since the valve body 21 of the control valve 20 for use of open (operation) moves together with the plunger 32, the valve body 21 can move only within a range of stroke of the plunger 32 by means of the solenoid 60. However, as shown in FIG. 5, it is also possible to mover the valve body 21, further, into the right-hand direction.

Upon the valve body 21 is applied the force of oil pressure directing from the right-hand side to the left-hand side, and this oil pressure force relates to the difference of cross-section area between the valve seat 25 and the cylindrical portion 24. On the other hand, a fluid force acts upon from the left-hand side to the right-hand side due to the fact that fluid flowing passing through the communication hole 103 flows into the space 20*b* of the secondary side from the space 20*a* of the primary side. In the ordinary fluid pressure operating apparatus, the maximum moving position of the valve body 21 is determined, by bringing those forces into a balance thereof. If changing this balance by decreasing the force of oil pressure acting upon from the right-hand side to the left-hand side, then the valve body 21 moves to the right-hand direction, further. As is apparent from this, for letting the valve body 21 to move into the right-hand direction, further, it is sufficient to reduce the difference of cross-section area between the valve seat 25 and the cylindrical portion 24.

In this manner, if making the moving stroke of the valve body 21 to be longer than that of the plunger 32, the moving stroke of the plunger 32 may be short without matter. It is possible to actuate the piston 5 more speedy, or to actuate the piston 5 of a large diameter.

When the operation of open-circuit of the piston 5 is completed, flow of the operating fluid stops, and then no fluid force acts upon the valve body 21. Since the fluid force comes to be zero, the valve body 21 moves into the left-hand direction due to a spring force of the second spring 31. And, it stops the movement thereof when contacting with the projection portion of the plunger 32 for use of open (operation). This condition is the condition of close (operation) shown in FIG. 4.

Further under the condition of open-circuit, the space 7*a* of the cylinder is communicated with the return side of low pressure. For this reason, the piston keeps the condition of open-circuit even if a very little leakage occurs in the control valve 40 for closed-circuit by any chance. The control valve 40 for closed-circuit is kept to be closed, due to force of the operating fluid upon the difference of cross-section area between the valve seat 45 and the cylindrical portion 46.

Figure 6:
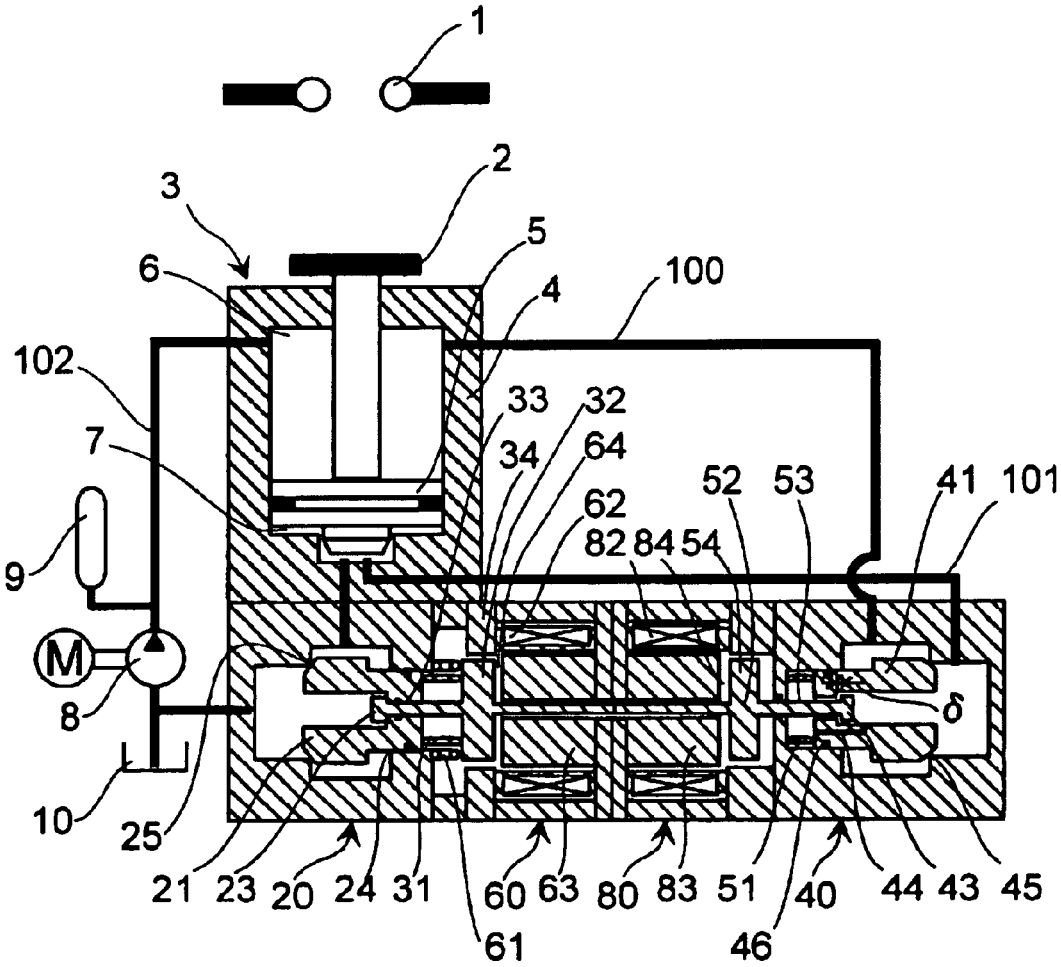
FIGS. 6 and 7 are the vertical cross-section views for explaining the operation of the circuit breaker shown in FIG. 1.

The situation is shown in FIG. 6, where an instruction of closed-circuit is generated, under the condition of open-circuit shown in FIG. 4. The coil 82 of the solenoid 80 for use of close (operation) is excited, and then a suction force generates between the disc portion 54 of the plunger 52 and the fixed core 83 of the solenoid 80 for use of close (operation). When this suction force overcomes the sum of a spring force of the third spring 51 and the friction force, a gap 84 between the disc portion 54 and the fixed core 83 is reduced. On the other hand, the plunger 32 for use of open (operation), being in contact with the plunger 52 for use of close (operation), spread out a gap 64 between the disc portion 34 of the plunger 32 for use of open (operation) and the fixed core 63 of the solenoid 60 for use of open (operation).

The valve body 21 of the control valve 20 for use of open (operation) and the plunger 32 for use of open (operation) are operated through a spring force of the second spring 31. Therefore, when the plunger 32 for use of open (operation) moves towards the left-hand direction, the valve body 21 of the control valve 20 also moves towards the left-hand direction, thereby closing the control valve 20 for use of open (operation). It is preferable that a gap δ is formed between the projection portion 43 of the plunger 52 for use of close (operation) and the valve body 41 of the control valve 40 for use of close (operation) under this condition. When forming the gap δ in this manner, it is possible to bring both the control valve 20 for use of open (operation) and the control valve 40 for use of close (operation) into the closed condition. And, it is also possible to prevent the pressure from blowing by, from a side of the accumulator 9 of high pressure to a side of reservoir 8 of low pressure. When the plunger 32 for use of open (operation) and the plunger 52 for use of close (operation) move toward the left-hand direction further, the valve body 41 of the control valve 40 for use of close (operation) and the projection portion 43 of the plunger 52 for use of close (operation) are in contact with each other.

Figure 7:
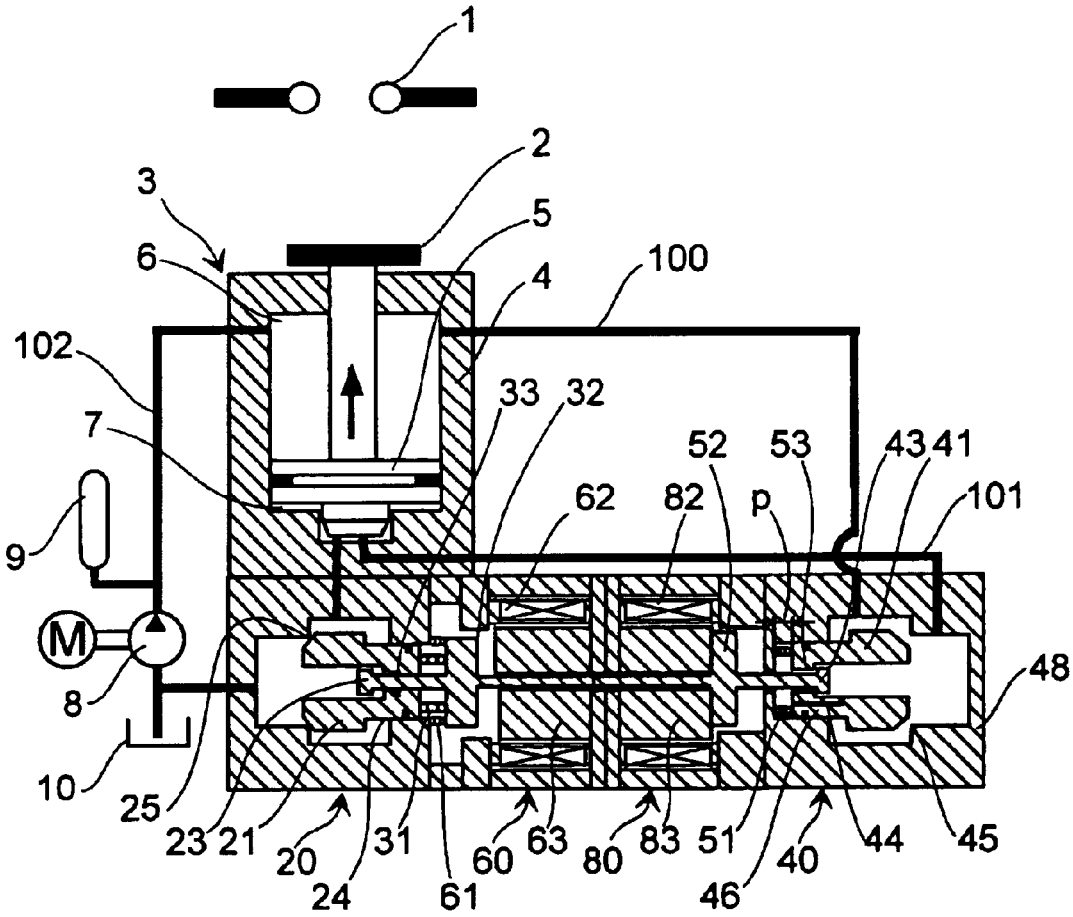

FIG. 7 shows the situation where the side surface of the disc portion 54 of the plunger 52 for use of close (operation) moves up to be in contact with the fixed core 83 of the solenoid 80 for use of close (operation). The suction force of the solenoid 80 for use of close (operation) overcomes the pressure of operating fluid upon the difference of cross-section area between the valve seat 45 and the disc portion 46 of the control valve 40 for use of close (operation), the spring force of the second spring 31, the spring force of the third spring 51, and the friction force, thereby moving the plunger 52 for use of close (operation) towards the left-hand direction. The plunger 52 for use of close (operation) and the valve body 41 of the control valve 40 for use of close (operation) move towards the left-hand direction as one body, thereby opening the control valve 40 for use of close (operation).

If it is possible to make the difference small in the diameter between the valve seat 45 and the cylindrical portion 46 of the control valve 40 for use of close (operation), the suction force can be small, which is necessary for driving the plunger 52 for use of close (operation). With this, the space 6 within the cylinder 4 is communicated to the supply side, and then both the spaces 6 and 7 are high in pressure. Since the pressure receiving area of the space 7*a* is larger than that of the space 6 by the cross-section area of the connecting rod 5*a*, the piston 5 is pushed upwards. The piston 5 and the movable contact 2 begin the closed-circuit operation.

When the closed-circuit operation proceeds, the piston 5 goes up to the top dead center, and the movable contact 2 is in contact with the contact 1. This condition is that shown in FIG. 1 mentioned above. Since the supply pressure of high pressure is applied onto the plunger 52 for use of close (operation), the plunger 52 for use of close (operation) keeps a position of suction, after cutting off of the current instruction of the solenoid 80 for use of close (operation). With this, the control valve 20 for use of close (operation) keeps the condition of being opened.

Figure 8:
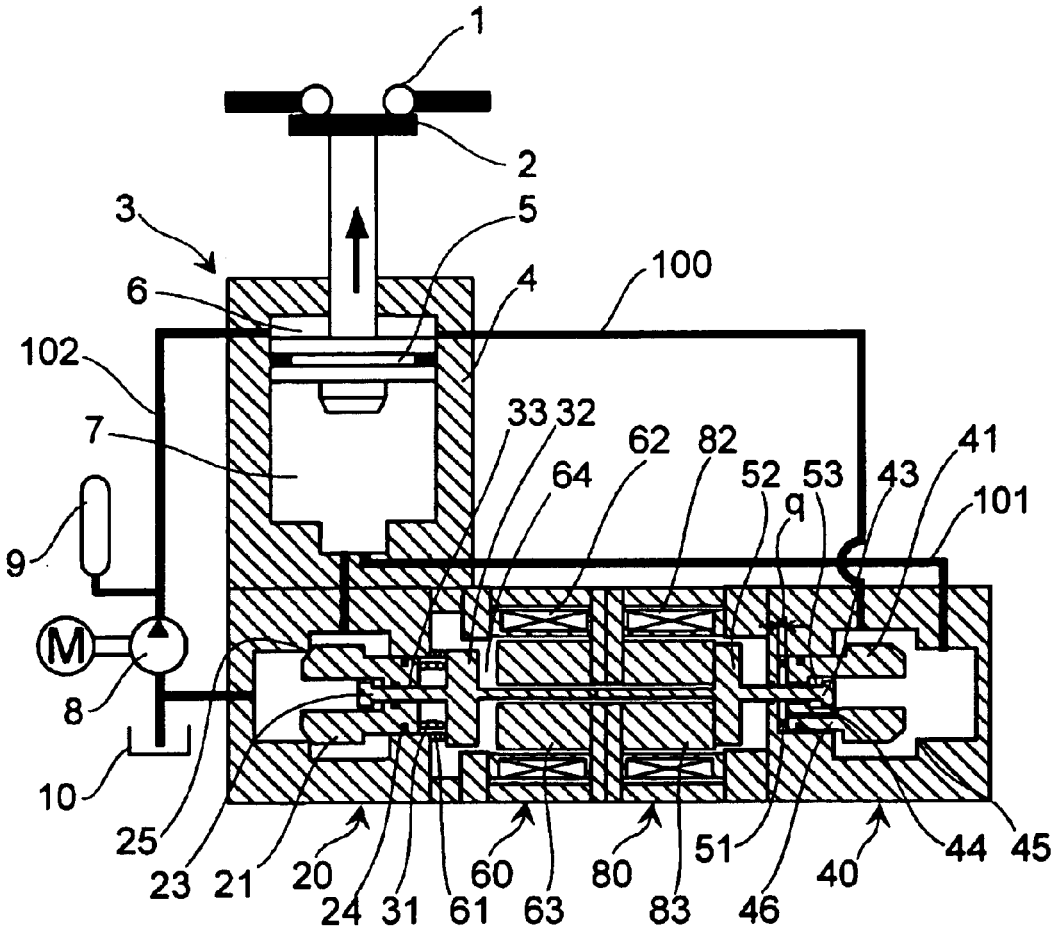
FIG. 8 is a vertical cross-section view for showing other variation of the circuit breaker shown in FIG. 1.

In the embodiment mentioned above, since the valve body 41 of the control valve 40 for use of close (operation) is so made up that it cannot move if the plunger 52 does not move, then the valve body 41 can move only up to the position of a distance "p" from the bottom of the housing 48. However, as shown in FIG. 8, it is also possible to make up so that it can move to the position of a distance "q" (<"p"), crossing over the distance "p". In the similar manner to the case of the control valve 20 for use of open (operation), it is sufficient to change the balancing condition between the fluid force and the oil pressure acting upon the valve seat 41. This can be achieved by decreasing the difference of cross-section area between the valve seat 45 and the disc portion 46.

In this manner, if bringing the moving stroke of the valve body 41 to be longer than that of the plunger 52, the moving stroke of the plunger 52 can be made short. Thus, it is possible to make the piston 5 operate quickly, or to operate the piston of a large diameter.

When completing the closed-circuit operation of the piston 5, no fluid force exists. The valve body 41 moves toward the right-hand direction due to the spring force of the third spring 51. And, it is in contact with the projection portion 43 of the plunger 52 for use of close (operation), thereby stopping. The condition where this plunger 52 for use of close (operation) stops the movement thereof is that shown in FIG. 1 mentioned above. Under the closed-circuit shown in FIG. 1, the space 7*a* within the cylinder 4 is communicated with the supply side of high pressure. Into the space 6 within the cylinder 4 is always applied the high pressure. The piston 5 keeps the closed-circuit condition even if a very small leakage occurs in the control valve 20 for use of open (operation). The control valve 20 for use of open (operation) is kept to be closed due to the supply pressure, which acts upon the difference of cross-section between the valve seat 25 and the cylindrical portion 24.

According to the present embodiment, since the control valves are controlled by electromagnetic solenoids, so as to operate the control valve for use of open (operation) and the control valve for use of close (operation), separately, therefore it is possible to prevent two (2) pieces of the control valves from opening at the same time, during the operation of open-circuit or closed-circuit. As a result of this, it is possible to avoid the blow-by of pressure from the supply side of high pressure to the reservoir side of low pressure, thereby obtaining a stable operation of the fluid pressure operating apparatus. Also, since the high pressure is always applied into one space of the cylinder operation chamber, while the other space thereof is communicated to the reservoir of low pressure when opening circuit, or to the supply side of high pressure when closing circuit, therefore it is possible to keep the open-circuit condition or the closed-circuit condition.

Figure 9:
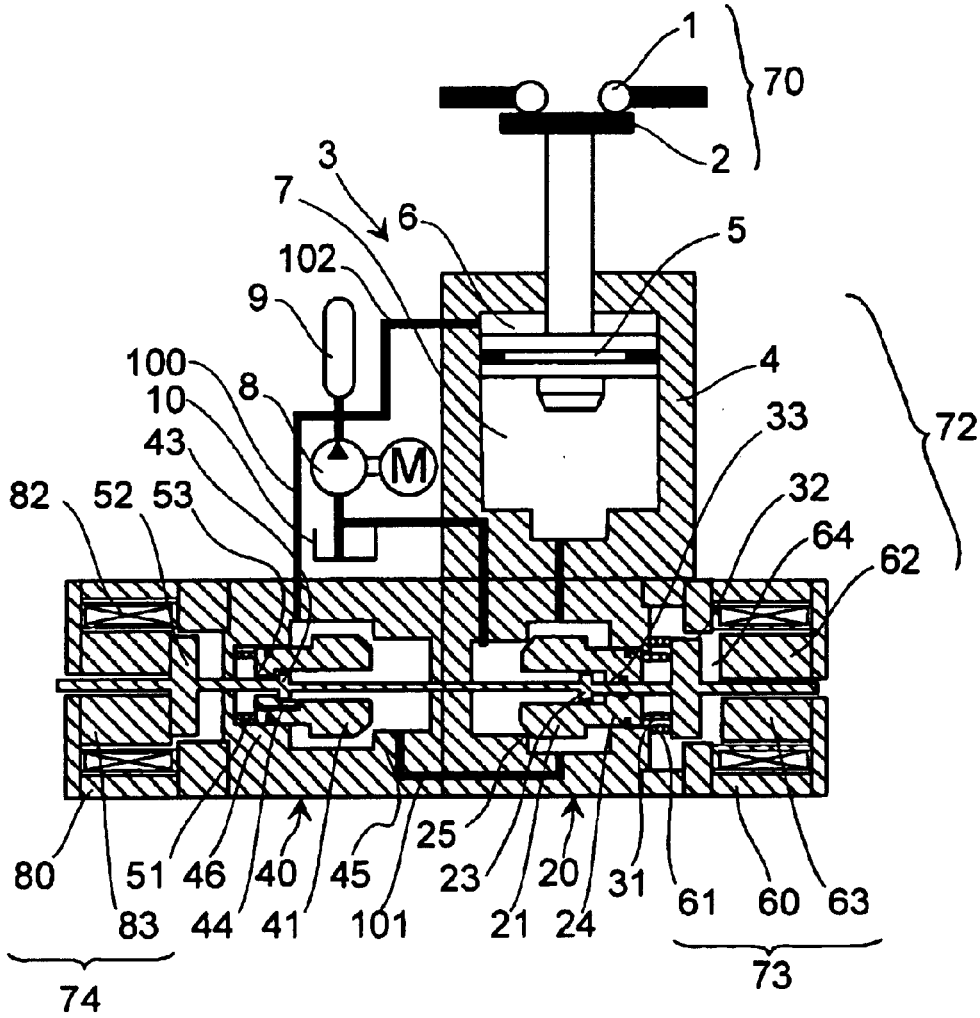
FIG. 9 is a vertical cross-section view of other embodiment of the circuit breaker, according to the present invention, corresponding to FIG. 1.

Other embodiment according to the present invention will be shown in FIG. 9. This FIG. 9 corresponds to that shown in FIG. 1 of the embodiment mentioned above. The present embodiment differs in the position of the driving portion from the embodiment mentioned above. In the embodiment mentioned above, a pair of the driving portions are connected, on the reverse surface side thereof, and are disposed between the control valve 40 for use of close (operation) and the control valve 20 for use of open (operation). According to the present embodiment, the control valve 20 for use of open (operation) and the control valve 40 for use of close (operation) are neighboring with each other, and on an outside of those are provided the driving portions 73 and 74, respectively. However, since the control valve 20 for use of open (operation) and the control valve 40 for use of close (operation) are neighboring with each other, the projection portion of the plunger 32 for use of open (operation) and the projection portion 43 of the plunger 52 for use of close (operation) are connected through a connection rod 90.

According to the present embodiment, since the plunger 32 for use of open (operation) and the plunger 52 for use of close (operation) move together as one unit, all of the operations in the embodiment mentioned above can be performed in the same manner. Also, since the control valve for use of open (operation) and the control valve for use of close (operation) are disposed within an inside than the driving portions, then it is possible to shorten the pipe length for each of the conduits, thereby obtaining a small-sizing. It is also possible to operate the plunger for use of open (operation) and the plunger for use of close (operation) by hands, directly from an outside thereof, therefore being cope with emergency, such as when cutting of an electric power source, etc.

As was mentioned in the above, according to the present invention, the control valves for driving the piston are driven, directly, by means of the solenoids, therefore it is possible to prevent the operating fluid of high pressure from blowing by to low pressure side, thereby enabling to improve reliability of the fluid pressure operating apparatus for the circuit breaker, as well as, the small-sizing thereof.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. A fluid pressure operating apparatus, comprising:

a fluid pressure cylinder for at least one of opening and closing a contact;

control valves usable for a respective open and close operation, for bringing said fluid pressure cylinder into an opened-circuit state and a closed-circuit state; and driving portions provided in each of those control valves, wherein said driving portions and said associated control valves useable for the opening and closing operations are disposed on a common axis.

2. The fluid pressure operating apparatus according to claim 1, wherein each of said control is a poppet valve, and each of said driving portions is a solenoid of a direct movement type.

3. The fluid pressure operating apparatus according to claim 2, wherein a plunger associated with each said solenoid and a valve body associated with each said poppet valve have engagement portions, and each of the engagement portions is sized to be longer at said valve body side than that at said plunger side.

4. A fluid pressure operating apparatus, comprising:

a fluid pressure cylinder for at least one of opening and closing a contact;

control valves for bringing said fluid pressure cylinder into an opened-circuit state and a closed-circuit state; and solenoids provided in the control valves for the open-circuit and closed circuit operation alone a common axis with the control valves, wherein each of said solenoids has a plunger therein, so that an operation initiating time of said control valves usable for an open operation differs from an operation initiating time of said control valves usable for close operation when operating to open a circuit and when operating to close a circuit.

5. The fluid pressure operating apparatus according to claim 4, wherein a penetrating hole is formed in each of said control valves, within which said plunger is able to move, and a projection portion is formed at a tip of said plunger, to engage with said control valve at said projection portion.

6. The fluid pressure operating apparatus according to claim 5, wherein both said plungers of said solenoids for driving the control valves usable for the open operation and for driving the control valves usable for the close operation are disposed on the common axis and adjoin each other on a side opposing to said projection portions of said plungers.

7. The fluid pressure operating apparatus according to claim 4, wherein a penetrating hole is formed in each of said control valves, within which penetrating hole said plunger is arranged to move, and a projection portion is formed on each of said plungers, for engaging said projection portions with said control valves, and further two pieces of said plungers are disposed on the common axis, and a connection rod is between the projection portions of said both plungers.

8. The fluid pressure operating apparatus according to claim 4, wherein each of said control valves is a poppet valve.

9. The fluid pressure operating apparatus according to claim 7, wherein said control valve usable for the open operation and said projection portion of the plunger engaging with said control valve usable for the open operation are in contact under a condition where said control valve usable for the open operation is closed, and a gap is defined between said control valve usable for the close operation and said projection portion of the plunger engaging with said control valve usable for the close operation under a condition where the plunger engaging with said control valve usable for the open operation and said control valve usable for the close operation are in contact.

10. The fluid pressure operating apparatus according to claim 7, wherein said control valve used for the close operation and said projection portion of the plunger engaging with said control valve used for the close operation are in contact under a condition where said control valve used for the close operation is closed, while a gap is defined between said control valve used for the open operation and said projection portion of the plunger engaging with said control valve used for the open operation under condition in which the plunger engaging with said control valve used for the close operation and said control valve used for the close operation are in contact.

* * * * *